US005790077A

United States Patent [19]

Luh et al.

[11] Patent Number: 5,790,077

[45] Date of Patent: Aug. 4, 1998

[54] ANTENNA GEOMETRY FOR SHAPED DUAL REFLECTOR ANTENNA

[75] Inventors: Howard H. Luh, Sunnyvale; Peter W. Lord, Mountain View, both of Calif.

[73] Assignee: Space Systems/Loral, Inc., Palo Alto, Calif.

[21] Appl. No.: 733,363

[22] Filed: Oct. 17, 1996

[51] Int. Cl.[6] ..... H01Q 19/19

[52] U.S. Cl. ..... 343/781 P; 343/781 CA; 343/840

[58] Field of Search ..... 343/781 P, 781 CA, 343/840, 837; H01Q 19/19

[56] References Cited

U.S. PATENT DOCUMENTS

| | | | |
|---|---|---|---|
| 4,755,826 | 7/1988 | Rao | 343/781 P |
| 4,783,664 | 11/1988 | Karikomi et al. | 343/781 P |
| 5,160,937 | 11/1992 | Fairlie et al. | 343/781 P |

*Primary Examiner*—Michael C. Wimer
*Attorney, Agent, or Firm*—Perman & Green, LLP

[57] ABSTRACT

A method for designing a shaped dual reflector antenna comprising the initial selection of a hyperboloidal or ellipsoidal reflective surface profile for the main reflector such that the cross-polarization of the contoured output RF signal beam of the resulting antenna structure is reduced.

4 Claims, 2 Drawing Sheets

ANTENNA GEOMETRY FOR SHAPED DUAL REFLECTOR ANTENNA

FIELD OF THE INVENTION

The present invention relates to antenna structures and more particularly, to the geometry for a shaped dual reflector antenna.

BACKGROUND OF THE INVENTION

An offset shaped dual reflector antenna generally comprises a main reflector, a subreflector, and an RF signal feed. The geometrical relationship between the main reflector, the subreflector, and the signal feed is typically based on either classical offset Gregorian geometry or classical offset Cassegrain geometry. Generally, in operation, an RF signal produced at the signal feed is first directed towards the subreflector. The subreflector then reflects the RF signal towards the main reflector which, in turn, reflects the RF signal towards the desired geographic coverage area associated with the antenna.

The design process of a shaped dual reflector antenna system is iterative in nature and often requires frequent fine tuning until the desired profiles of the shaped reflective surfaces are achieved. Since there are an infinite number of reflector profiles which can be used in combination to achieve a functionally operable shaped dual reflector antenna, selection of a proper surface profile as an initial condition in the design process will reduce design time and improve the purity of the polarization, which is of great importance. The initial condition is of practical importance in that it is used to define the working envelope of the subsequent shaped surface.

Historically, offset dual reflector antennas with a paraboloidal main reflector were primarily designed to produce a narrow RF signal beam. When a low cross-polarization beam is required, the main reflector, the subreflector and the feed must be in a special arrangement.

More recently, a contoured output RF signal beam, instead of a narrow output RF signal beam, has been desired, wherein a large geographic coverage area can be achieved. However, the resulting antenna structure designed with the previously known geometrical relationship between the main reflector, subreflector, and the signal feed is often unsatisfactory since the cross-polarization level of the contoured output beam is frequently too high.

OBJECT OF THE INVENTION

It is an object of this invention to provide a method to reduce the cross-polarization level associated with a contoured output RF signal of an offset shaped dual reflector antenna by initially selecting a hyperboloidal or ellipsoidal main reflector surface in the design process.

SUMMARY OF THE INVENTION

The foregoing and other problems are overcome and the object of the invention is realized by method in accordance with embodiments of this invention.

In accordance with one embodiment of the invention a method is provided for designing an offset shaped dual reflector antenna initially selecting a hyperboloidal main reflector surface in combination with a hyperboloidal subreflector surface, and a signal feed, the main reflector, subreflector, and signal feed having an initial geometric relationship, wherein the resultant shaped dual reflector antenna reduces cross-polarization of a transmitted RF signal.

In accordance with another embodiment of the invention a method is provided for designing an offset shaped dual reflector antenna initially selecting a hyperboloidal main reflector surface in combination with an ellipsoidal subreflector surface, and a signal feed, the main reflector, subreflector, and signal feed having an initial geometric relationship, wherein the resultant shaped dual reflector antenna reduces cross-polarization of a transmitted RF signal.

In accordance with another embodiment of the invention a method is provided for designing an offset shaped dual reflector antenna initially selecting an ellipsoidal main reflector surface in combination with a hyperboloidal subreflector surface, and a signal feed, the main reflector, subreflector, and signal feed having an initial geometric relationship, wherein the resultant shaped dual reflector antenna reduces cross-polarization of a transmitted RF signal.

In accordance with another embodiment of the invention a method is provided for designing an offset shaped dual reflector antenna initially selecting an ellipsoidal main reflector surface in combination with an ellipsoidal subreflector surface, and a signal feed, the main reflector, subreflector, and signal feed having an initial geometric relationship, wherein the resultant shaped dual reflector antenna reduces cross-polarization of a transmitted RF signal.

BRIEF DESCRIPTION OF THE DRAWINGS

The above set forth and other features of the invention are made more apparent in the ensuing Detailed Description of the Invention when read in conjunction with the attached Drawings, wherein.

DETAILED DESCRIPTION OF THE INVENTION

Figure 1:
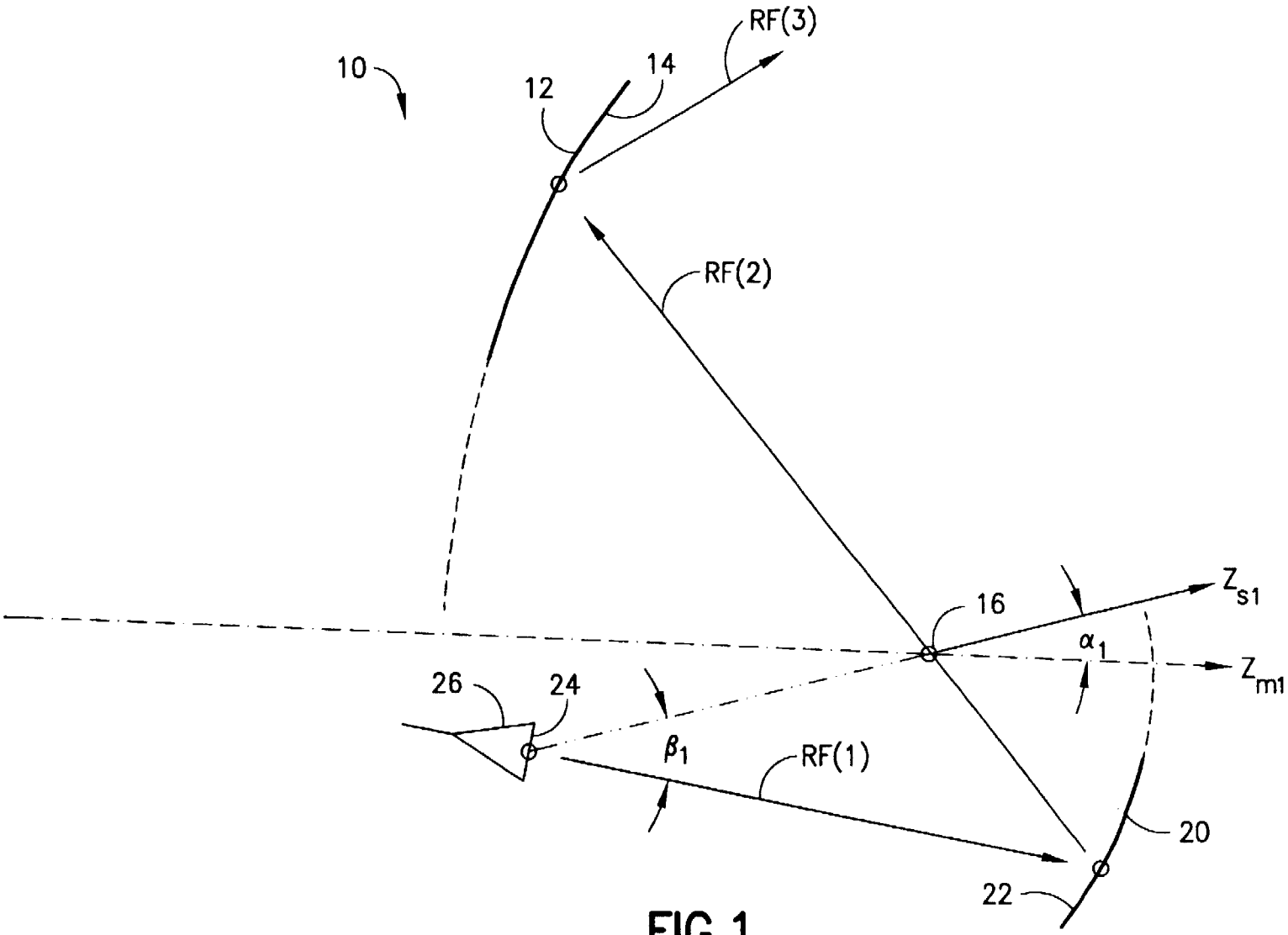
FIG. 1 is a side plane view of an embodiment of a shaped dual reflector antenna with classical offset Gregorian geometry comprising a main reflector, a subreflector, and a signal feed.
Figure 2:
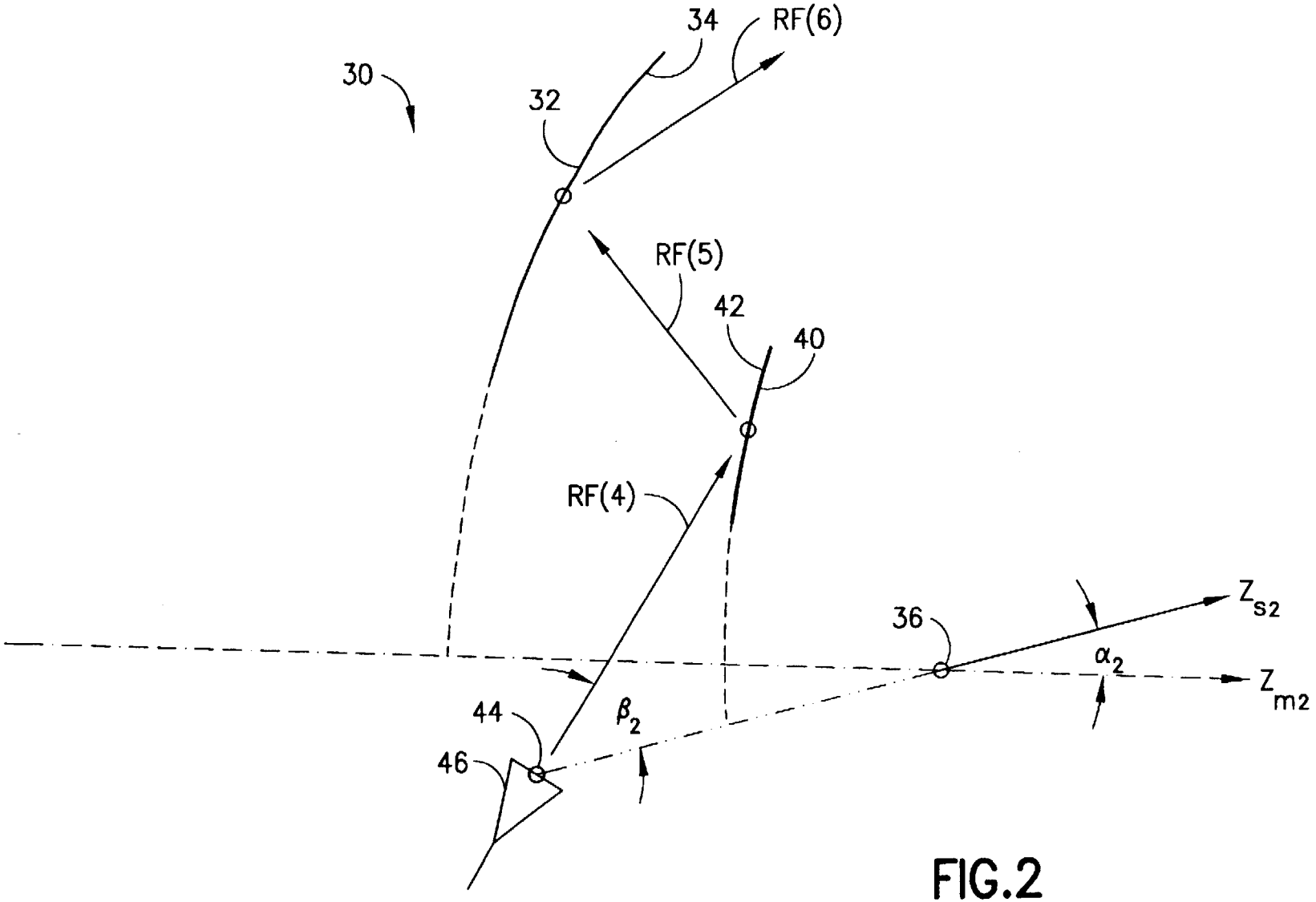
FIG. 2 is a side plane view of an embodiment of a shaped dual reflector antenna with classical offset Cassegrain geometry comprising a main reflector, a subreflector, and a signal feed.

Referring to the accompanying drawings, FIGS. 1 and 2 depict the shaped dual reflector geometries. Specifically, FIG. 1 depicts an antenna 10 with classical offset Gregorian geometry. Antenna 10 comprises, in combination, a main reflector 12, a subreflector 20, and an RF signal feed 26.

The main reflector 12 and the subreflector 20 are confocused, whereby the main reflector 12 and the subreflector 20 share a common focus 16. A line $Z_{M1}$ is formed along the major axis of main reflector 12 passing through focus 16 of main reflector 12. A line $Z_{S1}$ is formed along the major axis of subreflector 20 passing through focus 16 of subreflector 20 and a focus 24 of subreflector 20. Main reflector 12 further comprises an inner reflective surface 14 and subreflector 20 further comprises an inner reflective surface 22, whereby when an RF signal is produced at signal feed 26, which is located at focus 24 of subreflector 20, and directed towards the subreflector 20 along a path RF(1), the RF signal is reflected by the inner reflective surface 22 of subreflector 20 and directed towards the inner surface 14 of main reflector 12 along a path RF(2). The inner surface 14 of main reflector 12 reflects the RF signal and directs the RF signal to a target geographic area along a path RF(3). Line $Z_{S1}$, and line $Z_{M1}$ define an angle $\alpha_1$ with respect to focus 16. Further, line $Z_{S1}$, and RF signal path RF(1) define an angle $\beta_1$ with respect to focus 24. Typically the reflective surface 22 of subreflector 20 is an ellipsoidal surface. Additionally, the RF signal produced at signal feed 26 directed along path RF(1) is modified by the reflective inner surface 22 of subreflector 20 and the RF signal reflected from surface 22 directed along path RF(2) is further modified by reflective inner surface 14 of main reflector 12 such that the RF signal along path RF(3) has been expanded to ensure a specific geographic radiating coverage.

Referring next to FIG. 2, a shaped dual reflector antenna 30 in classical offset Cassegrain geometry is shown. Antenna 30 comprises a main reflector 32, a subreflector 40, and an RF signal feed 46. Similar to antenna 10, the main reflector 32 and the subreflector 40 of antenna 30 are confocused, whereby the main reflector 32 and the subreflector 40 share a common focus 36. A line $Z_{M2}$ is formed along the major axis of main reflector 32 passing through focus 36 of main reflector 32. A line $Z_{S2}$ is formed along the major axis of subreflector 40 passing through focus 36 of subreflector 40 and a focus 44 of subreflector 40. Main reflector 32 further comprises an inner reflective surface 34 and subreflector 40 further comprises an outer reflective surface 42, whereby an RF signal is produced at signal feed 46, which is located at focal point 44 of subreflector 40, and directed towards the subreflector 40 along a path RF(4), the RF signal is reflected by the outer surface 42 of subreflector 40 and directed towards the inner surface 34 of main reflector 32 along a path RF(5). The inner surface 34 of main reflector 32 reflects the RF signal and directs the RF signal to a target geographic area along a path RF(6). Line $Z_{S2}$ and line $Z_{M2}$ define an angle $\alpha_2$ with respect to focus 36. Further, line $Z_{S1}$, and RF signal path RF(4) define an angle $\beta_2$ with respect to focus 44. Typically, the reflective outer surface 42 of subreflector 40 is hyperboloidal. As with the shaped dual reflector antenna based on Gregorian geometry, the RF signal produced at signal feed 46 directed along path RF(4) is modified by the reflective outer surface 42 of subreflector 40 and the RF signal reflected from surface 42 directed along path RF(5) is further modified by reflective inner surface 34 of main reflector 32 such that the RF signal along path RF(6) has been expanded to ensure a specific geographic radiating coverage.

When the inner reflective surface 14, 34 of main reflector 12, 32 is paraboloidal, and the geometric relationship between the main reflector 12, 32, the subreflector 20, 40, and the feed 26, 46 satisfies the following equation:

$$\tan\beta = \frac{-(1-e_S^2)\sin\alpha}{(1+e_S^2)\cos\alpha - 2e_S}, \quad (1)$$

Where:

$e_s$ is the eccentricity of the reflective surface 22, 42 of subreflector 20, 40, $\beta=\beta_1$ for a shaped dual reflector antenna based on Gregorian geometry, $\alpha=\alpha_1$ for a shaped dual reflector antenna based on Gregorian geometry, $\beta=\beta_2$ for a shaped dual reflector antenna based on Cassegrain geometry, and $\alpha=\alpha_2$ for a shaped dual reflector antenna based on Cassegrain geometry, the purity of polarization of the narrow output signal beam improves.

However, as described above, the resultant shaped dual reflector antenna, designed to produce a contoured output RF signal beam, which is iterated from this initial geometry is often unsatisfactory since the cross-polarization level of the output RF signal is frequently too high.

The present invention however, provides a shaped dual reflector antenna with reduced cross-polarization in the contoured output RF signal. In a preferred embodiment, as an initial condition in the design of a shaped dual reflector antenna, the shape of the inner reflective surface 14, 34 of main reflector 12, 32 is selected as either hyperboloidal or ellipsoidal. Additionally, the initial geometric relationship between the main reflector 12, 32, the subreflector 20, 40, and the RF signal feed 26, 46 of a shaped dual reflector antenna, whose main reflector 12, 32 has either a hyperboloidal or ellipsoidal inner reflective surface 14, 34, satisfies the following equation:

$$\tan\beta = \frac{-e_m(1-e_S^2)\sin\alpha}{e_m(1+e_S^2)\cos\alpha - e_S(1+e_m^2)}, \quad (2)$$

Where:

$e_m$ is the eccentricity of the reflective surface 14, 34 of main reflector 12, 32, $e_s$ is the eccentricity of the reflective surface 22, 42 of subreflector 20, 40, $\beta=\beta_1$ for a shaped dual reflector antenna based on Gregorian geometry, $\alpha=\alpha_1$ for a shaped dual reflector antenna based on Gregorian geometry, $\beta=\beta_2$ for a shaped dual reflector antenna based on Cassegrain geometry, and $\alpha=\alpha_2$ for a shaped dual reflector antenna based on Cassegrain geometry.

In a preferred embodiment where the inner reflective surface 14, 34 of main reflector 12, 32 is selected as either hyperboloidal or ellipsoidal, the main reflector 12, 32 and the subreflector 20, 40 cooperate to transform an RF signal produced at signal feed 26, 46, whereby the RF signal produced at signal feed 26, 46 directed along path RF(1), RF(4) is modified by the reflective surface 22, 42 of subreflector 20, 40 and the RF signal reflected from surface 22, 42 of subreflector 20, 40 directed along path RF(2), RF(5) is further modified by reflective inner surface 14, 34 of main reflector 12, 32 such that the cross-polarization level of the RF signal along path RF(3), RF(6) is reduced without degradation to the geographic radiating coverage of the RF signal.

Equation (2) is a generalization of equation (1). For example, when the shape of the reflective surface 14, 34 of main reflector 12, 32 is paraboloidal, whose eccentricity $e_m$ is 1, equation (2) reduces to equation (1).

While the invention has been particularly shown and described with respect to preferred embodiments thereof, it will be understood by those skilled in the art that changes in form and details may be made therein without departing from the scope and spirit of the invention.

What is claimed is:

1. A method for designing a shaped dual reflector antenna based on Gregorian geometry, wherein the cross-polarization of the contoured output RF signal beam is reduced, comprising the steps of:

providing a main reflector, said main reflector having an inner reflective surface profile that is initially hyperboloidal;

providing a subreflector, said subreflector having an inner reflective surface profile that is initially ellipsoidal, said main reflector and said subreflector sharing at least one common focus; and providing an RF signal feed, said RF signal feed is located at a focus of said subreflector, said RF signal feed directs an RF signal along a signal path towards said inner reflective surface of said subreflector, said inner reflective surface of said subreflector reflecting said RF signal along a signal path towards said inner reflective surface of said main reflector, said inner reflective surface of said main reflector reflecting said RF signal along a signal path towards a target geographical coverage area, said RF signal feed and the major axis of said subreflector defining an angle β, said major axis of said subreflector and the major axis of said main reflector defining an angle α, wherein the initial geometrical relationship between said main reflector, said subreflector, and said RF signal feed satisfies the following equation:

$$\tan\beta = \frac{-e_m(1-e_S^2)\sin\alpha}{e_m(1+e_S^2)\cos\alpha - e_S(1+e_m^2)}$$

where:

$e_m$ is the eccentricity of said main reflector, $e_s$ is the eccentricity of said subreflector, α is the tilted angle of said major axis of said subreflector with respect to said major axis of said main reflector, and β is the angle between said major axis of said subreflector and the axis of said feed.

2. A method for designing a shaped dual reflector antenna based on Gregorian geometry, wherein the cross-polarization of the contoured output RF signal beam is reduced, comprising the steps of:

providing a main reflector, said main reflector having an inner reflective surface profile that is initially ellipsoidal;

providing a subreflector, said subreflector having an inner reflective surface profile that is initially ellipsoidal, said main reflector and said subreflector sharing at least one common focus; and providing an RF signal feed, said RF signal feed is located at a focus of said subreflector, said RF signal feed directs an RF signal along a signal path towards said inner reflective surface of said subreflector, said inner reflective surface of said subreflector reflecting said RF signal along a signal path towards said inner reflective surface of said main reflector, said inner reflective surface of said main reflector reflecting said RF signal along a signal path towards a target geographical coverage area, said RF signal feed and the major axis of said subreflector defining an angle β, said major axis of said subreflector and the major axis of said main reflector defining an angle α, wherein the initial geometrical relationship between said main reflector, said subreflector, and said RF signal feed satisfies the following equation:

$$\tan\beta = \frac{-e_m(1-e_S^2)\sin\alpha}{e_m(1+e_S^2)\cos\alpha - e_S(1+e_m^2)}$$

where:

$e_m$ is the eccentricity of said main reflector, $e_s$ is the eccentricity of said subreflector, α is the tilted angle of said major axis of said subreflector with respect to said major axis of said main reflector, and β is the angle between said major axis of said subreflector and the axis of said feed.

3. A method for designing a shaped dual reflector antenna based on Cassegrain geometry, wherein the cross-polarization of the contoured output RF signal beam is reduced, comprising the steps of:

providing a main reflector, said main reflector having an inner reflective surface profile that is initially hyperboloidal;

providing a subreflector, said subreflector having an outer reflective surface profile that is initially hyperboloidal, said main reflector and said subreflector sharing at least one common focus; and providing an RF signal feed, said RF signal feed is located at a focus of said subreflector, said RF signal feed directs an RF signal along a signal path towards said outer reflective surface of said subreflector, said outer reflective surface of said subreflector reflecting said RF signal along a signal path towards said inner reflective surface of said main reflector, said inner reflective surface of said main reflector reflecting said RF signal along a signal path towards a target geographical coverage area, said RF signal feed and the major axis of said subreflector defining an angle β, said major axis of said subreflector and the major axis of said main reflector defining an angle α, wherein the initial geometrical relationship between said main reflector, said subreflector, and said RF signal feed satisfies the following equation:

$$\tan\beta = \frac{-e_m(1-e_S^2)\sin\alpha}{e_m(1+e_S^2)\cos\alpha - e_S(1+e_m^2)}$$

where:

$e_m$ is the eccentricity of said main reflector, $e_s$ is the eccentricity of said subreflector, α is the tilted angle of said major axis of said subreflector with respect to said major axis of said main reflector, and β is the angle between said major axis of said subreflector and the axis of said feed.

4. A method for designing a shaped dual reflector antenna based on Cassegrain geometry, wherein the cross-polarization of the contoured output RF signal beam is reduced, comprising the steps of:

providing a main reflector, said main reflector having an inner reflective surface profile that is initially ellipsoidal;

providing a subreflector, said subreflector having an outer reflective surface profile that is initially hyperboloidal, said main reflector and said subreflector sharing at least one common focus; and providing an RF signal feed, said RF signal feed is located at a focus of said subreflector, said RF signal feed directs an RF signal along a signal path towards said outer reflective surface of said subreflector, said outer reflective surface of said subreflector reflecting said RF signal along a signal path towards said inner reflective surface of said main reflector, said inner reflective surface of said main reflector reflecting said RF signal along a signal path towards a target geographical coverage area, said RF signal feed and the major axis of said subreflector defining an angle β, said major axis of said subreflector and the major axis of said main reflector defining an angle α, wherein the initial geometrical relationship between said main reflector, said subreflector, and said RF signal feed satisfies the following equation:

$$\tan\beta = \frac{-e_m(1-e_s^2)\sin\alpha}{e_m(1+e_s^2)\cos\alpha - e_s(1+e_m^2)}$$

where:

$e_m$ is the eccentricity of said main reflector, $e_s$ is the eccentricity of said subreflector, α is the tilted angle of said major axis of said subreflector with respect to said major axis of said main reflector, and β is the angle between said major axis of said subreflector and the axis of said feed.

* * * * *